US009616479B2

(12) United States Patent
Ota et al.

(10) Patent No.: US 9,616,479 B2
(45) Date of Patent: Apr. 11, 2017

(54) MOLDING METHOD FOR PLATE-SHAPED WORKPIECE, AND MOLDED ARTICLE

(75) Inventors: Takahiro Ota, Tokyo (JP); Daisuke Ogura, Tokyo (JP); Atsushi Sugai, Tokyo (JP); Ken Ishii, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 349 days.

(21) Appl. No.: 13/635,476

(22) PCT Filed: Mar. 18, 2011

(86) PCT No.: PCT/JP2011/056523

§ 371 (c)(1),
(2), (4) Date: Sep. 17, 2012

(87) PCT Pub. No.: WO2011/115244

PCT Pub. Date: Sep. 22, 2011

(65) Prior Publication Data

US 2013/0008222 A1 Jan. 10, 2013

(30) Foreign Application Priority Data

Mar. 18, 2010 (JP) ..... 2010-062625
Mar. 18, 2010 (JP) ..... 2010-062626

(51) Int. Cl.
*B21D 11/02* (2006.01)
*B21D 11/08* (2006.01)
*B21D 11/20* (2006.01)

(52) U.S. Cl.
CPC ..... *B21D 11/08* (2013.01); *B21D 11/206* (2013.01); *B21D 11/02* (2013.01); *Y10T 428/1241* (2015.01)

(58) Field of Classification Search
CPC ..... B21D 11/08; B21D 11/02; B21D 25/02; B21D 5/01; B21D 22/02; B21D 11/20;
(Continued)

(56) References Cited

U.S. PATENT DOCUMENTS 2,431,173 A * 11/1947 Hawkes ..... 72/297
3,222,911 A * 12/1965 Kirkpatrick et al. ..... 72/363
(Continued)

FOREIGN PATENT DOCUMENTS

CN 1296865 5/2001
CN 1714162 12/2005
(Continued)

OTHER PUBLICATIONS

Chinese Office Action issued Jan. 23, 2014 in corresponding Chinese Patent Application No. 201180014274.0 with English translation.

(Continued)

*Primary Examiner* — David Bryant
*Assistant Examiner* — Gregory Swiatocha
(74) *Attorney, Agent, or Firm* — Wenderoth, Lind & Ponack, L.L.P.

(57) ABSTRACT

Provided is a molding method for a plate-shaped workpiece including forming a concave portion (11) at one surface (1*a*) of a plate-shaped workpiece (1), and bending the plate-shaped workpiece (1) having the concave portion (11) such that the one surface (1*a*) becomes a concave surface and a rear surface (1*b*) thereof becomes a convex surface.

19 Claims, 7 Drawing Sheets

(58) Field of Classification Search

CPC ..... B21D 11/206; B21D 21/00; B21D 37/18; B21D 22/201; B30B 9/14; B61D 17/00; B61D 17/02; B61D 17/04; B23P 25/00; B23P 15/00; B23P 15/02; B23P 15/06; C21D 1/68; B21J 3/00; B21C 22/32; C10N 2240/40; Y10T 29/4981; Y10T 29/49812

USPC ... 72/379.2, 166, 302, 378, 363, 389.1, 267; 29/423, 424

See application file for complete search history.

(56) References Cited

U.S. PATENT DOCUMENTS

| | | | | |
|---|---|---|---|---|
| 5,956,991 | A * | 9/1999 | Tseng | 72/213 |
| 6,800,038 | B2 * | 10/2004 | Willett | A63B 53/04 473/329 |
| 7,875,333 | B2 * | 1/2011 | Stephan | B32B 3/02 244/120 |
| 2001/0028016 | A1 * | 10/2001 | Tomura | 242/520 |
| 2008/0040910 | A1 * | 2/2008 | Chen | A63B 53/0466 29/557 |
| 2010/0096765 | A1 * | 4/2010 | Kuwayama et al. | 264/40.1 |

FOREIGN PATENT DOCUMENTS

| | | | |
|---|---|---|---|
| DE | 198 10 196 | | 9/1999 |
| EP | 1 820 578 | | 8/2007 |
| JP | 54-2260 | | 1/1979 |
| JP | 59-169628 | | 9/1984 |
| JP | 8-132395 | | 5/1996 |
| JP | 2003-25021 | | 1/2003 |
| JP | 2004-154853 | | 6/2004 |
| JP | 2005-144536 | | 6/2005 |
| JP | 2006-35245 | | 2/2006 |
| JP | 2007-508952 | | 4/2007 |
| JP | 2007-301618 | | 11/2007 |
| JP | 2009-736 | | 1/2009 |
| JP | 2009000736 | A * | 1/2009 |
| JP | 4283784 | | 6/2009 |

OTHER PUBLICATIONS

International Search Report issued Jul. 19, 2011 in International (PCT) Application No. PCT/JP2011/056523.

Written Opinion of the International Searching Authority issued Jul. 19, 2011 in International (PCT) Application No. PCT/JP2011/056523.

Extended European Search Report dated May 7, 2015 issued in corresponding European Patent Application No. 11756427.8.

* cited by examiner

RELATION BETWEEN YOUNG'S MODULUS AND RADIUS OF CURVATURE OF SHIM

MOLDING METHOD FOR PLATE-SHAPED WORKPIECE, AND MOLDED ARTICLE

TECHNICAL FIELD

The present invention relates to a molding method for a plate-shaped workpiece and a molded article.

Priority is claimed on Japanese Patent Application Nos. 2010-62625 and 2010-62626, filed Mar. 18, 2010, the content of which is incorporated herein by reference.

BACKGROUND ART

In a conventional art, an outer plate or the like, applied to a fuselage of a civil aircraft employs an aluminum alloy plate to reduce the weight thereof, and, in order to further reduce the weight, processing of partially thinning a plate member, i.e., wall thinning, is performed. Then, the outer plate forming a fuselage shape of an aircraft is molded to have a curved shape with a certain radius of curvature, and in general, wall thinning is performed by chemical milling after press bending of the flat plate. In addition, as the other molding methods, for example, methods disclosed in the following Patent Documents 1 and 2 are provided.

Patent Document 1 discloses a method of performing wall thinning by machining after an outer plate is molded at a flat plate state.

Patent Document 2 has proposed a molding method for a plate-shaped workpiece, in which a shot material is projected to the plate-shaped workpiece to provide a predetermined radius of curvature, the method including a pre-process of adjusting a plate thickness of the plate-shaped workpiece, before performing the molding to provide a predetermined radius of curvature, such that the plate-shaped workpiece can function as a product after the molding, and a process of projecting the shot material to the plate-shaped workpiece passed through the pre-process to provide the predetermined radius of curvature.

CITATION LIST

Patent Document

[Patent Document 1] Published Japanese Translation No. 2007-508952 of the PCT International Publication

[Patent Document 2] Japanese Unexamined Application, First Publication No. 2003-25021

SUMMARY OF INVENTION

Problems to be Solved by the Invention

However, in the conventional molding method of the related art, the chemical milling after press-bending of the flat plate requires a long processing time, and industrial waste such as liquid solution or the like, may be generated.

In addition, in Patent Document 1, since the machining is performed to the outer plate curved with a certain radius of curvature, there is a need to use a ball end mill, and manufacturing efficiency may be decreased.

Further, in Patent Document 2, while a method of projecting a shot material to perform molding is provided, it is difficult to provide reproducibility with precision, and modification may be needed.

Accordingly, the molding method without such problems as described above is needed, and thus, there is a margin for improvement.

In consideration of the above-mentioned problems, it is an object of the present invention to provide a molding method for a plate-shaped workpiece and a molded article that are capable of improving manufacturing efficiency and suppressing generation of industrial waste.

In addition, it is another object of the present invention to provide a molding method for a plate-shaped workpiece and a molded article that are capable of providing good reproducibility with molding precision

Means for Solving the Problems

A molding method for a plate-shaped workpiece in accordance with the present invention includes a process of forming a concave portion at one surface of the plate-shaped workpiece, and a process of pressing the plate-shaped workpiece against a mold member to perform bending processing.

A first aspect of the molding method of the present invention includes a process of forming a concave portion at a concave surface (a surface to be molded into the concave surface) side of the plate-shaped workpiece, and a process of bending the plate-shaped workpiece from one surface to the other surface by press or roll bending. Here, the concave surface in the present invention represents one surface (a first surface) to be molded into the concave surface by bending, among two flat surfaces of the plate-shaped workpiece, and the convex surface represents the other surface (a second surface) to be molded into the convex surface by bending. That is, the first aspect of the molding method of the present invention includes a process of forming a concave portion in the first surface of the plate-shaped workpiece, and a process of bending the plate-shaped workpiece by press or roll bending such that the first surface becomes a concave surface and the second surface becomes a convex surface.

A second aspect of a molding method for a plate-shaped workpiece in accordance with the present invention includes a process of forming a concave portion at a concave surface side of the plate-shaped workpiece, and a process of applying a tensile force while a jig having a convex shape abuts the concave surface side of the plate-shaped workpiece. That is, the second aspect of the molding method of the present invention includes a process of forming a concave portion at a first surface of the plate-shaped workpiece, and a process of bending the plate-shaped workpiece by applying a tensile force to the plate-shaped workpiece, while a mold member having a convex shape abuts the first surface of the plate-shaped workpiece, such that the first surface becomes a concave surface and the second surface becomes a convex surface.

In addition, a molded article in accordance with the present invention is manufactured by the above-mentioned molding method for a plate-shaped workpiece.

According to the present invention, since wall thinning with respect to the plate-shaped workpiece is performed in a state in which the plate-shaped workpiece is in a flat plate shape before bending processing, machining using an end mill in a conventional triaxial machining apparatus can be performed. Moreover, since a large diameter end mill can be used, time consumed for the wall thinning can be reduced and manufacturing efficiency can be improved.

In addition, since the wall thinning is performed by machining, there is no waste liquid generated when chemical milling is used, and further, since chips generated by cutting of end mill can be reused as scraps, generation of industrial waste is suppressed.

Furthermore, as the plate-shaped workpiece passed through the wall thinning process is bent using a press machine or a roll bending machine and a tensile force is applied to the plate-shaped workpiece to perform stretch molding, reproducibility of molding precision is good and modification of the plate member is unnecessary so that molding time can be reduced in comparison with the conventional method in which the shot material is projected.

In the molding method for a plate-shaped workpiece in accordance with the present invention, a plurality of concave portions may be formed at one surface of the plate-shaped workpiece at predetermined intervals.

According to the present invention, as the plurality of concave portions are formed at one side surface of the plate-shaped workpiece at predetermined intervals, the plate-shaped workpiece can be bent at a certain radius of curvature.

In the molding method for a plate-shaped workpiece in accordance with the present invention, a process of inserting a shim having a shape corresponding to the concave portion and formed of a material having a lower Young's modulus than the plate-shaped workpiece into the concave portion may be provided.

According to the present invention, as the shim having a lower Young's modulus than the plate-shaped workpiece is inserted into the concave portion formed in the plate-shaped workpiece, the shim is curved by elastic deformation to follow the bending of the plate-shaped workpiece during the bending processing so that a bending radius of the plate-shaped workpiece after the molding can be increased. For this reason, since a bending radius at a wall thinning section, in which the concave portion is formed, approaches a bending radius of a regular section, in which no concave portion is formed, there is no difference in bending shape between the wall thinning section and the regular section, and a smooth concave surface shape can be obtained without being curved in a polygonal shape.

In the molding method for a plate-shaped workpiece in accordance with the present invention, the shim may be loosely fit into the concave portion.

According to the present invention, when plate-shaped workpiece is bent, since the elastic deformation of the shim is absorbed by a minus tolerance of the shim with respect to the concave portion, adhesion between the shim and the concave portion is increased. For this reason, even in the bending processing, the shim can be prevented from coming off of the concave portion.

In the molding method for a plate-shaped workpiece in accordance with the present invention, the shim may be formed of a material having a lower Young's modulus than a processed subject, which may be Bakelite (phenol resin) having a Young's modulus of 7 to 10 GPa.

According to the present invention, as the shim formed of Bakelite having a Young's modulus of 7 to 10 GPa is used, better adhesion performance with respect to the concave portion can be obtained. That is, it is possible to suppress an inconvenience in which the curve of the shim is reduced to deteriorate followability with respect to the concave portion to reduce the adhesion, or on the other hand, in which the shim is excessively bent to be separated from the concave portion.

In addition, in the molding method for a plate-shaped workpiece in accordance with the present invention, the concave portion may be formed in a stepped shape.

In the present invention, as the shim also has a stepped portion corresponding to the stepped portion having the stepped shape of the concave portion, the adhesion at the stepped portions can be further increased, followability can be increased, and the plate-shaped workpiece can be smoothly bent.

Further, in the molding method for a plate-shaped workpiece in accordance with the present invention, in the plate-shaped workpiece having the concave portion, a first ratio of a maximum cross-sectional area divided by a minimum cross-sectional area of a vertical cross-section in a tensile direction less than or equal to a second ratio of tensile strength divided by bearing force of the material.

In the present invention, when the first ratio is greater than the second ratio, generation of rupture or local wall thinning due to stress larger than the tensile strength being generated at a minimum cross-section portion can be prevented.

Effects of Invention

According to the molding method for a plate-shaped workpiece of the present invention, since the wall thinning of the plate-shaped workpiece is performed in a flat plate state before bending processing of the plate-shaped workpiece is performed, machining can be performed by a conventional triaxial machining apparatus using an end mill. As a result, manufacturing efficiency can be improved. Further, in comparison with the wall thinning by the chemical milling, generation of industrial waste can be suppressed.

In addition, according to the first aspect of the molding method for a plate-shaped workpiece of the present invention, since the bending processing with respect to the plate-shaped workpiece is performed using a processing machine such as a press machine, a roll bending machine, or the like, good reproducibility with molding precision can be provided.

Further, according to the second aspect of the molding method for a plate-shaped workpiece of the present invention, since the bending processing with respect to the plate-shaped workpiece is performed using a stretch molding machine that applies a tensile force to the plate-shaped workpiece, good reproducibility with molding precision can be provided.

DETAILED DESCRIPTION OF THE INVENTION

Hereinafter, a molding method for a plate-shaped workpiece and molded article in accordance with embodiments of the present invention will be described with reference to the accompanying drawings. Such embodiments exemplarily show an aspect of the present invention, and are not considered to limit the present invention, but may be arbitrarily modified without departing from the technical spirit of the present invention. In addition, in the following drawings, for the convenience of easy description, scales and numbers of each structure may differ from that of the actual structure.

(First Embodiment)

Figure 1:
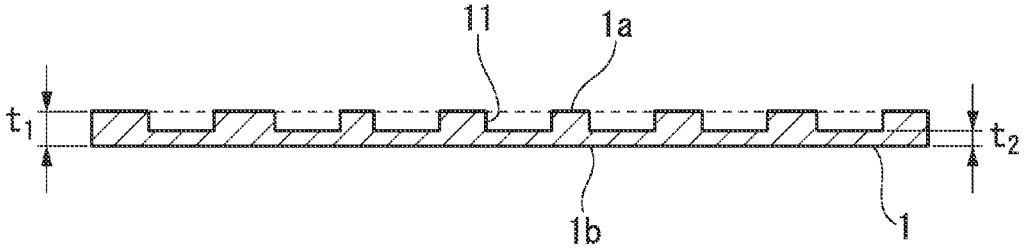
FIG. 1 is a cross-sectional view showing a wall-thinned plate-shaped workpiece according to a first embodiment of the present invention.
Figure 2:
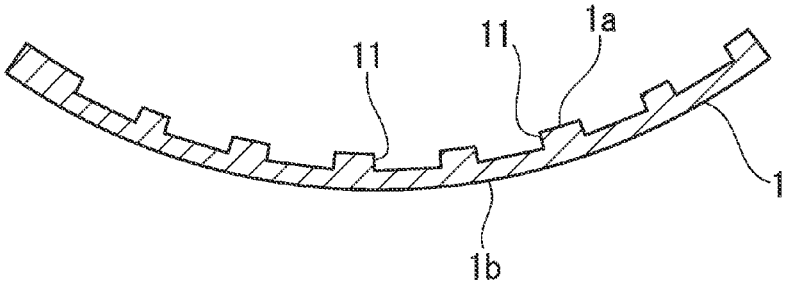
FIG. 2 is a cross-sectional view showing a state in which bending processing is performed on the wall-thinned plate-shaped workpiece.

A plate-shaped workpiece 1 shown in FIGS. 1 and 2 is, for example, a portion of a cylindrical outer plate used in a fuselage of an aircraft, and is bent at a predetermined radius of curvature through a molding method of a first embodiment. An aluminum alloy is used in the plate-shaped workpiece 1. In addition, the plate-shaped workpiece 1 corresponds to a "molded article" of the present invention.

Figure 3:
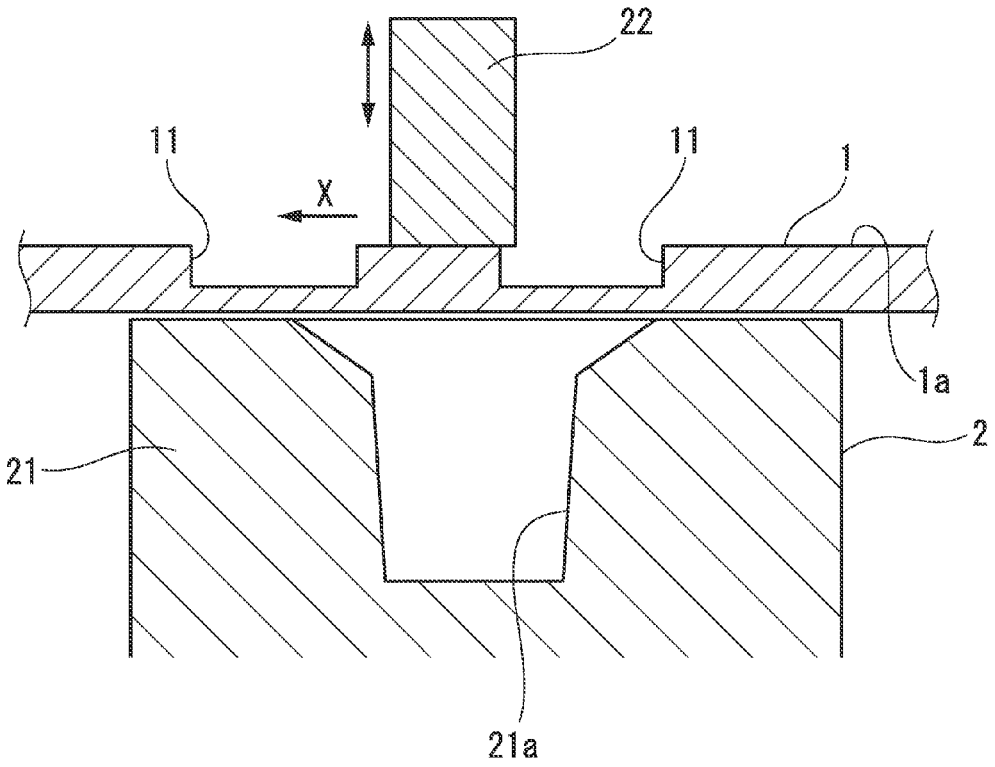
FIG. 3 is a partial cross-sectional view showing a bending process by a press machine.

Here, in the first embodiment shown in FIGS. 1 to 3, an upper side surface of the plate-shaped workpiece 1 is referred to as a first surface (a concave surface) 1*a* to be molded into a concave surface, and a lower side surface of the plate-shaped workpiece 1 is referred to as a second surface (a convex surface) 1*b* to be molded into a convex surface.

The molding method for the plate-shaped workpiece 1 according to the first embodiment includes a wall thinning process of forming a plurality of pockets 11 (concave portions) at the first surface 1*a* side in a surface direction of the plate-shaped workpiece 1 at predetermined intervals, and a bending process of bending the plate-shaped workpiece 1 by a press machine from one surface to the other surface, i.e., from the second surface 1*b* toward the first surface 1*a*.

That is, the molding method of the first embodiment includes a wall thinning process of forming the plurality of pockets 11 in the first surface 1*a* of the plate-shaped workpiece 1, and a bending process of bending the plate-shaped workpiece 1 using the press machine such that the first surface 1*a* of the plate-shaped workpiece 1 becomes concave and the second surface 1*b* becomes convex.

The pocket 11 is disposed at a predetermined position of the first surface 1*a* of the plate-shaped workpiece 1, and is formed to have, for example, a substantially rectangular shape when seen from a plan view and to have an appropriate thickness dimension by the wall thinning process.

Next, the molding method for the plate-shaped workpiece 1 will be described in detail.

First, in the wall thinning process, the plate-shaped workpiece 1 in a flat plate state shown in FIG. 1 is cut by a conventional triaxial machining apparatus equipped with, for example, an end mill, to a predetermined depth (thickness dimension) at predetermined positions, to form the plurality of pockets 11.

Next, in the bending process, as shown in FIG. 3, the plate-shaped workpiece 1 passed through the wall thinning process is placed on a lower mold 21 of a press machine 2. Here, the press machine 2 includes a pair of upper and lower molds (the lower mold 21 and an upper mold 22), and has a structure in which the upper mold 22 is vertically moved with respect to the fixed lower mold 21. A width dimension of the lower mold 21 and the upper mold 22 is larger than that of the plate-shaped workpiece 1. In addition, an open concave portion 21*a* is formed at a position of the lower mold 21 corresponding to the upper mold 22.

Then, the upper mold 22 is pushed against the plate-shaped workpiece 1 into the lower mold 21 side of to locally press the plate-shaped workpiece 1 placed on the lower mold 21, to bend the plate-shaped workpiece 1. Then, as the pressing operation by the upper mold 22 is sequentially repeated while conveying the curved plate-shaped workpiece 1 in a circumferential direction (in a direction of an arrow X of FIG. 3), the plate-shaped workpiece 1 in a flat plate shape can be cylindrically bent, and the first surface 1*a* can be formed into a smooth concave shape, i.e., the concave surface 1*a* can be formed in the plate-shaped workpiece 1.

As a specified example of the molding method, the plate-shaped workpiece 1 having a width dimension of 2 m, a length dimension of 6 m and a plate thickness dimension t1 of about 4 mm and formed of an aluminum alloy of 2024-T3 is provided, wall thinning is performed by machining using an end mill having a tool diameter of 50 mm such that a plate thickness dimension t2 is locally reduced to 2 mm, and then, bending processing is performed to form a cylindrical shape having a radius of curvature of about 3 m using the press machine 2.

In the molding method for a plate-shaped workpiece and the molded article according to the above-mentioned first embodiment, since the wall thinning to form the pockets 11 in the first surface 1*a* of the plate-shaped workpiece 1 is performed in the flat plate state before the plate-shaped workpiece 1 is bent, the machining using the end mill can be performed by the conventional triaxial machining apparatus. In addition, since a large diameter end mill can be used, time consumed for the wall thinning can be reduced and manufacturing efficiency can be improved.

In addition, since the bending processing is performed with respect to the wall-thinned plate-shaped workpiece 1 using the press machine 2, good reproducibility with molding precision is provided and modification of the plate member is unnecessary so that molding time can be reduced in comparison with the conventional method in which the shot material is projected.

Further, since the wall thinning is performed by the machining, there is no generation of waste liquid when the chemical milling is performed. Moreover, since chips generated by cutting of the end mill can be reused as scraps, generation of the industrial waste can be suppressed.

Next, while another embodiment according to a molding method for a plate-shaped workpiece of the present invention will be described with reference to the accompanying drawings, the same or similar members and portions of the first embodiment are designated by the same reference numerals, and description thereof will not be repeated, but configurations different from those of the previous embodiment will be described.

(Second Embodiment)

Figure 4:
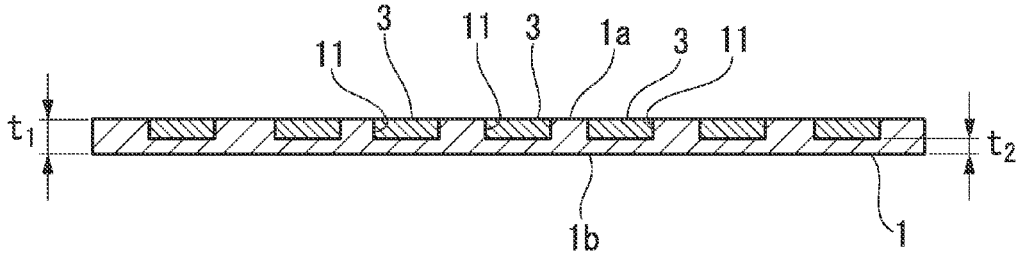
FIG. 4 is a cross-sectional view showing a wall-thinned plate-shaped workpiece according to a second embodiment, in which shims are inserted into concave portions.
Figure 5:
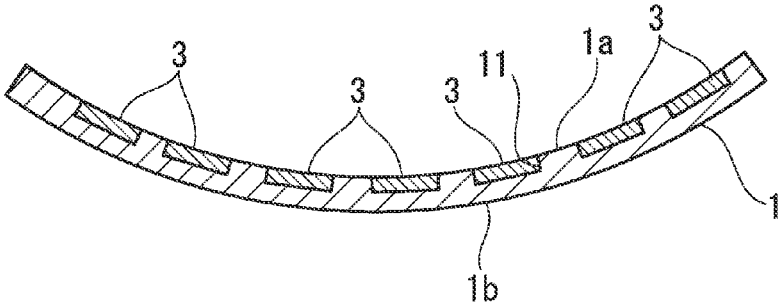
FIG. 5 is a cross-sectional view showing a state in which bending processing is performed on the plate-shaped workpiece into which the shims are inserted.

As shown in FIGS. 4 and 5, a molding method for a plate-shaped workpiece according to a second embodiment includes a process of inserting shims 3 having a shape corresponding to the pockets 11 formed in the first surface 1*a* of the plate-shaped workpiece 1 and formed of a material having a lower Young's modulus than the plate-shaped workpiece 1, after the wall thinning process in the first embodiment. In addition, in the bending process, since the same press machine 2 (see FIG. 3) as the above-mentioned embodiment is used, detailed description thereof will not be repeated.

The shim 3 may be formed of a material having good adhesion and fitting with respect to the pocket 11 fitted thereto, preferably, may be formed of a member having a Young's modulus of 5 to 25 GPa, and more preferably, may be formed of Bakelite of 7 to 10 GPa.

Then, the shim 3 is formed at a minus tolerance slightly smaller than an inner hole dimension of the pocket 11 to be loosely fitted into the pocket 11. That is, the shim 3 fitted into the pocket 11 is adhered to the pocket 11 to be in a state in which a slip is generated by elastic deformation in response to a force received from the outside.

In the second embodiment, as the shim 3 is employed, in a state in which a difference (a plate thickness dimension difference Δt) between a first plate thickness dimension t1 (see FIG. 4) of a regular section having no pocket 11 and a second plate thickness dimension t2 (see FIG. 4) of a wall thinning section having the pocket 11 is eliminated, the bending process can be performed.

Specifically, as the shim 3 formed of a material having a lower Young's modulus (for example, 5 to 25 GPa as described above) than the plate-shaped workpiece 1 is inserted into the pocket 11 formed in the plate-shaped workpiece 1, the shim 3 is curved by elastic deformation following the bending of the plate-shaped workpiece 1 during the bending processing, and thus, a bending radius of the plate-shaped workpiece 1 after the molding can be increased.

For this reason, since the bending radius at the wall thinning section having the pocket 11 approaches the bending radius of the regular section, a difference in bending shape between the wall thinning section and the regular section is eliminated, and a smooth concave surface shape having a certain radius of curvature can be obtained without being curved in a polygonal shape (bending to form a polygonal shape having an apex of the regular section of a large plate thickness dimension).

In addition, since the shim 3 is loosely fitted into the pocket 11, when the plate-shaped workpiece 1 is bent, the elastic deformation of the shim 3 is absorbed by the minus tolerance of the shim 3 with respect to the pocket 11 to increase adhesion between the shim 3 and the pocket 11. For this reason, even in the bending processing, the shim 3 can be prevented from coming-off of the pocket 11.

Further, as Bakelite is used as the material having a Young's modulus of 7 to 10 GPa as described above, better adhesion performance can be obtained.

In addition, when the Young's modulus of the shim 3 is 25 GPa or more, an elastic deformation amount of the shim 3 is small, and cannot easily deform. Accordingly, followability of the shim 3 with respect to the bending of the pocket 11 is deteriorated to generate a gap therebetween, decreasing adhesion. Meanwhile, when the Young's modulus of the shim 3 is less than 5 GPa, since an elastic deformation amount of the shim 3 is large, and can easily deform, it is difficult to curve the plate-shaped workpiece 1 to a certain radius of curvature.

(Third Embodiment)

Figure 6:
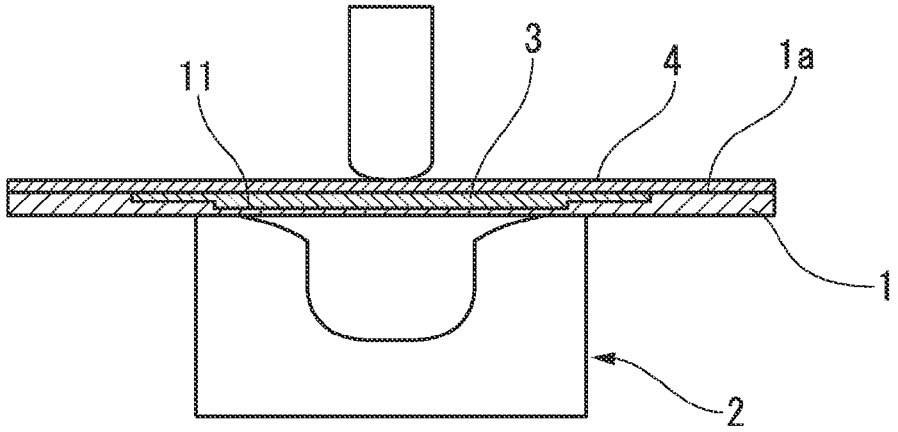
FIG. 6 is a partial cross-sectional view showing a bending process of a plate-shaped workpiece according to a third embodiment.
Figure 7:
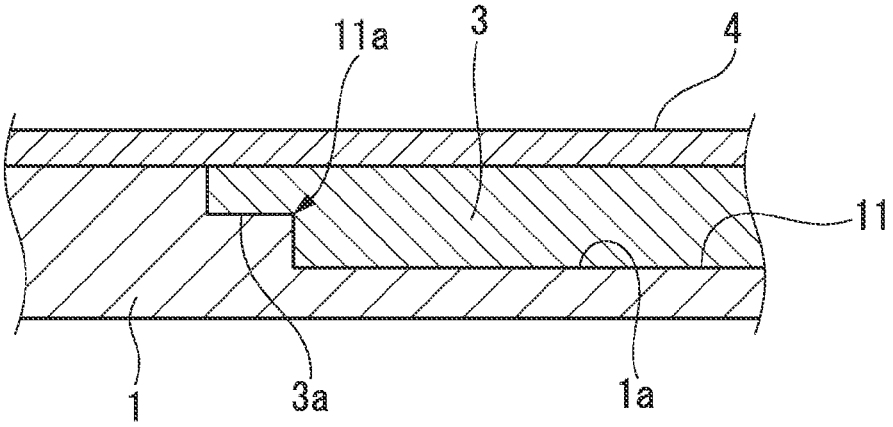
FIG. 7 is an enlarged partial cross-sectional view of a periphery of a concave portion of the plate-shaped workpiece shown in FIG. 6.

As shown in FIGS. 6 and 7, in a molding method for a plate-shaped workpiece according to a third embodiment, in which shapes of the pocket 11 and the shim 3 of the molding method according to the second embodiment are replaced, wall thinning is performed to form a stepped portion 11*a* having a stepped shape (one stage in the embodiment) at a corner in the pocket 11 of the plate-shaped workpiece 1, and a shim 3 having a stepped portion 3*a* corresponding to the stepped portion 11*a* is fitted into the pocket 11. In addition, in a state in which the shim 3 is fitted into the pocket 11, a sheet-shaped protective member 4 formed of urethane rubber, and so on, is disposed at the first surface 1*a* of the plate-shaped workpiece 1.

Further, in the bending process, since the same the press machine 2 (see FIG. 3) as the above-mentioned embodiment is used, detailed description thereof will not be repeated.

In this case, followability of the stepped portion 3*a* of the shim 3 at the stepped portion 11*a* of the pocket 11 is increased, adhesion of the stepped portion can be further improved, and the plate-shaped workpiece 1 can be smoothly bent at a certain radius of curvature.

In addition, the protective member 4 is placed on the first surface 1*a*, and performs a stoppage function to suppress protrusion of the shim 3 from the pocket 11 during the bending processing.

(Fourth Embodiment)

Figure 8:
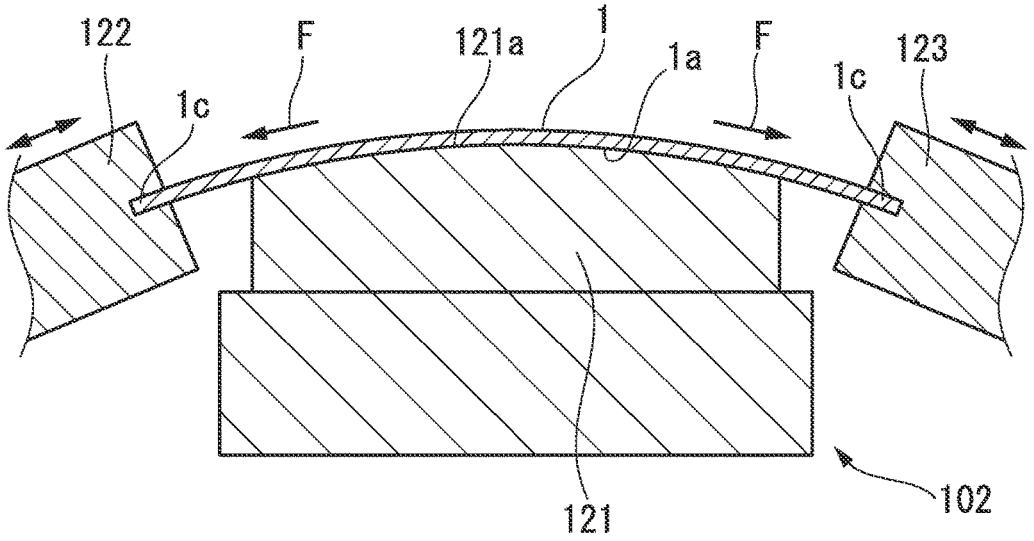
FIG. 8 is a side cross-sectional view showing stretch molding of a plate-shaped workpiece according to a fourth embodiment.

As shown in FIG. 8, in a molding method for a plate-shaped workpiece according to a fourth embodiment, in a bending process, instead of the bending processing by the press machine of the first embodiment, stretch molding is performed to apply a tensile force to the plate-shaped workpiece.

The molding method for the plate-shaped workpiece 1 according to the fourth embodiment includes a wall thinning process of forming a plurality of pockets 11 (concave portions) at a first surface 1*a* side in a surface direction of the plate-shaped workpiece 1 at predetermined intervals, and a bending process of performing the stretch molding to apply a tensile force while a convex portion of a lower mold 21 (mold member) abuts a first surface 1*a* of the plate-shaped workpiece 1.

That is, the molding method of the fourth embodiment includes a wall thinning process of forming the plurality of pockets 11 at the first surface 1*a* of the plate-shaped workpiece 1, and a bending process of applying a tensile force to the plate-shaped workpiece 1 while the convex portion of the lower mold 121 abuts the first surface 1*a* of the plate-shaped workpiece 1. In addition, in the wall thinning process, since the same processing as the first embodiment is performed, detailed description thereof will not be repeated.

Here, the plate-shaped workpiece 1 having the pocket 11 should have sufficient strength to enable the stretch molding. Then, a molding member in which a first ratio e1 of a maximum cross-sectional area divided by a minimum cross-sectional area of a vertical cross-section in a tensile direction after the wall thinning is less than or equal to a second ratio e2 of tensile strength divided by bearing force of a material is used in the plate-shaped workpiece 1.

As a result, similar to the case in which the first ratio e1 is greater than the second ratio e2 (el >e2), generation of rupture or local wall thinning due to stress larger than the tensile strength applying to the minimum cross-section portion can be prevented.

The pocket 11 is disposed at a predetermined position of the first surface 1*a* of the plate-shaped workpiece 1, and is formed to have, for example, a substantially rectangular shape when seen from a plan view and to have an appropriate thickness dimension by the wall thinning.

Next, the molding method for the plate-shaped workpiece 1 will be more specifically described.

First, in the wall thinning process, for example, the conventional triaxial machining apparatus equipped with an end mill is used with respect to the plate-shaped workpiece 1 in a flat plate state, and wall thinning processing is performed with a predetermined depth (thickness dimension) to a predetermined positions to form the plurality of pockets 11 (see FIG. 1).

For example, wall thinning of the plate-shaped workpiece 1 having a width dimension of 2 m, a length dimension of 6 m and a plate thickness dimension t1 of about 4 mm and formed of an aluminum alloy member of 2024-T3 can be performed through machining using an end mill having a tool diameter of 50 mm to have a local plate thickness dimension t2 of 2 mm.

Next, in the stretch molding by the bending process, as shown in FIG. 8, the plate-shaped workpiece 1 passed through the wall thinning process is placed on the lower mold 121.

As shown in FIG. 8, a stretch molding machine 102 configured to perform stretch molding includes the lower mold 121 having a curved convex surface 121*a* of an appropriate radius of curvature on an upper surface thereof, and a pair of tensile machines 122 and 123 configured to grip both ends 1*c* and 1*c* of the plate-shaped workpiece 1 disposed on the lower mold 121 and apply a tensile force F along the curved convex surface 121*a*. The tensile machines 122 and 123 face each other with the lower mold 121 interposed therebetween and are disposed at both sides in a curved direction (tangential direction) of the curved convex surface 121*a* of the lower mold 121, and can grip both ends 1*c* of the plate-shaped workpiece 1 set on the lower mold 121. Further, the tensile machines 122 and 123 can reciprocate in the tangential direction so as to approach and separate from each other.

Then, after gripping both ends 1*c* and 1*c* of the plate-shaped workpiece 1 placed on the lower mold 121 by the tensile machines 122 and 123, the tensile machines 122 and 123 are moved in a direction away from each other to apply a tensile force F to the plate-shaped workpiece 1 so that the plate-shaped workpiece 1 extends in the tangential direction to be curved along the curved convex surface 121*a*. Accordingly, the plate-shaped workpiece 1 having the flat plate shape can be cylindrically bent to form the first surface 1*a* into a smooth concave shape, i.e., the concave surface 1*a* can be formed at the plate-shaped workpiece 1.

Here, in the plate-shaped workpiece 1, since tension by the tensile force F applied from the stretch molding machine 102 is evenly applied to the entire surface, large stress is applied to a thin portion (a wall thinning section), in which wall thinning is performed, and only small stress is applied to a thick portion (a regular section having no pocket). For this reason, the plate-shaped workpiece 1 requires that stress of a cross-section of the regular section be larger than bearing force of the member and larger than yield stress, and stress of the wall thinning section be lower than the tensile strength.

On the other hand, in the embodiment, as described above, as a molding member in which a first ratio e1 of a maximum cross-sectional area divided by a minimum cross-sectional area of a vertical cross-section in a tensile direction of the plate-shaped workpiece 1 passed through the wall thinning process is less than or equal to a second ratio e2 of tensile strength divided by bearing force of the material is used, appropriate stretch molding can be performed without generating local wall thinning, rupture, or the like.

In the molding method for a plate-shaped workpiece and molded article according to the first embodiment, since the stretch molding is performed to apply a tensile force to the plate-shaped workpiece 1 passed through the wall thinning process using the stretch molding machine 102, good reproducibility with molding precision can be provided, modification is unnecessary, and molding time can be reduced, in comparison with the conventional art in which the shot material is projected.

(Fifth Embodiment)

Figure 9:
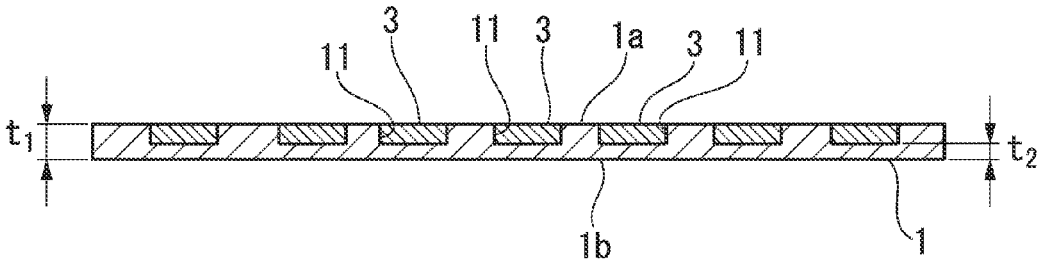
FIG. 9 is a cross-sectional view showing a wall-thinned plate-shaped workpiece according to a fifth embodiment, in which shims are inserted into concave portions.
Figure 10:
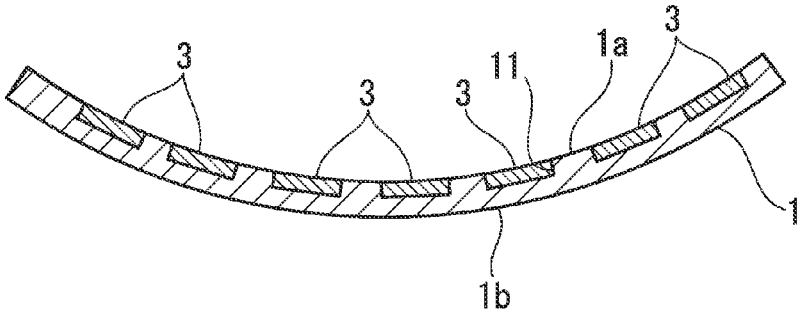
FIG. 10 is a cross-sectional view showing a state in which bending processing is performed on the plate-shaped workpiece into which the shims are inserted.

As shown in FIGS. 9 and 10, a molding method for a plate-shaped workpiece according to a fifth embodiment includes a process of inserting shims 3 having a shape corresponding to the pockets 11 formed in the first surface 1*a* of the plate-shaped workpiece 1 and formed of a material having a lower Young's modulus than the plate-shaped workpiece 1 after the wall thinning process in the fourth embodiment. In addition, in the bending process, the stretch molding machine 102 (see FIG. 8) similar to the fourth embodiment is used.

The shim 3 may be formed of a material having high adhesion and fitting with respect to the pocket 11 fitted thereto, preferably, may be formed of a member having a Young's modulus of 5 to 25 GPa, and more preferably, may be formed of Bakelite of 7 to 10 GPa.

Then, the shim 3 is formed at a minus tolerance slightly smaller than an inner hole dimension of the pocket 11 to be loosely fitted into the pocket 11. That is, the shim 3 fitted into the pocket 11 is adhered to the pocket 11 to be in a state in which a slip is generated by elastic deformation in response to a force received from the outside.

In the fifth embodiment, as the shim 3 is employed, in a state in which a difference (a plate thickness dimension difference Δt) between a first plate thickness dimension t1 (see FIG. 9) of a regular section having no pocket 11 and a second plate thickness dimension t2 (see FIG. 9) of a wall thinning section having the pocket 11 is eliminated, the bending process can be performed.

Specifically, as the shim 3 formed of a material having a lower Young's modulus (for example, 5 to 25 GPa as described above) than the plate-shaped workpiece 1 is inserted into the pocket 11 formed in the plate-shaped workpiece 1, the shim 3 is curved by elastic deformation following the bending of the plate-shaped workpiece 1 during the bending processing, and thus, a bending radius of the plate-shaped workpiece 1 after the molding can be increased.

For this reason, since the bending radius at the wall thinning section having the pocket 11 approaches the bending radius of the regular section, a difference in bending shape between the wall thinning section and the regular section is eliminated, and a smooth concave surface shape having a certain radius of curvature can be obtained without being curved in a polygonal shape (bending to form a polygonal shape having an apex of the regular section of a large plate thickness dimension).

In addition, since the shim 3 is loosely fitted into the pocket 11, when the plate-shaped workpiece 1 is bent, the elastic deformation of the shim 3 is absorbed by the minus tolerance of the shim 3 with respect to the pocket 11 to increase adhesion between the shim 3 and the pocket 11. For this reason, even in the bending processing, the shim 3 can be prevented from coming off of the pocket 11.

Further, as Bakelite is used as the material having a Young's modulus of 7 to 10 GPa as described above, better adhesion performance can be obtained.

In addition, when the Young's modulus of the shim 3 is 25 GPa or more, an elastic deformation amount of the shim 3 is small and cannot easily deform. Accordingly, followability of the shim 3 with respect to the bending of the pocket 11 is deteriorated to generate a gap therebetween, decreasing adhesion. Meanwhile, when the Young's modulus of the shim 3 is less than 5 GPa, since an elastic deformation amount of the shim 3 is large and can easily deform, it is difficult to curve the plate-shaped workpiece 1 to a certain radius of curvature.

EXAMPLE

Next, an experimental example performed to demonstrate effects according to the molding method for a plate-shaped workpiece and the molded article in accordance with the second and third embodiments will be described.

In the example, a shim formed of Bakelite was fitted into a pocket, and a radius of curvature of the plate-shaped workpiece by the bending processing was checked. Specifically, FEM analysis was used, a model of the plate-shaped workpiece and the shim was written, in a state in which the shim was fitted into the pocket having a predetermined shape and size, bending of the plate-shaped workpiece was analyzed under the following conditions, and the radius of curvature of the plate-shaped workpiece was obtained with varying a Young's modulus at each shim.

In addition, the workpiece can be effectively bent as the radius of curvature obtained by the analysis is increased.

As analysis conditions, the plate-shaped workpiece 1 had a first plate thickness dimension t1 of 6.87 mm and a second plate thickness dimension t2 of 2.51 mm, and the plate-shaped workpiece 1 was formed of an elastic-plastic body having a Young's modulus of 72 Pa, a Poisson's ratio of 0.33, a density of 2.77 g/cm$^3$, and a yield stress of 324 MPa. Density of the shim 3 was 1.32 g/cm$^3$. Further, as conditions of the bending processing, a coefficient of friction between the mold and the material and between the materials was 0.2, a molding speed (conveyance speed) was 10 mm/sec, and a conveyance stroke was about 8.9 mm.

Figure 11:
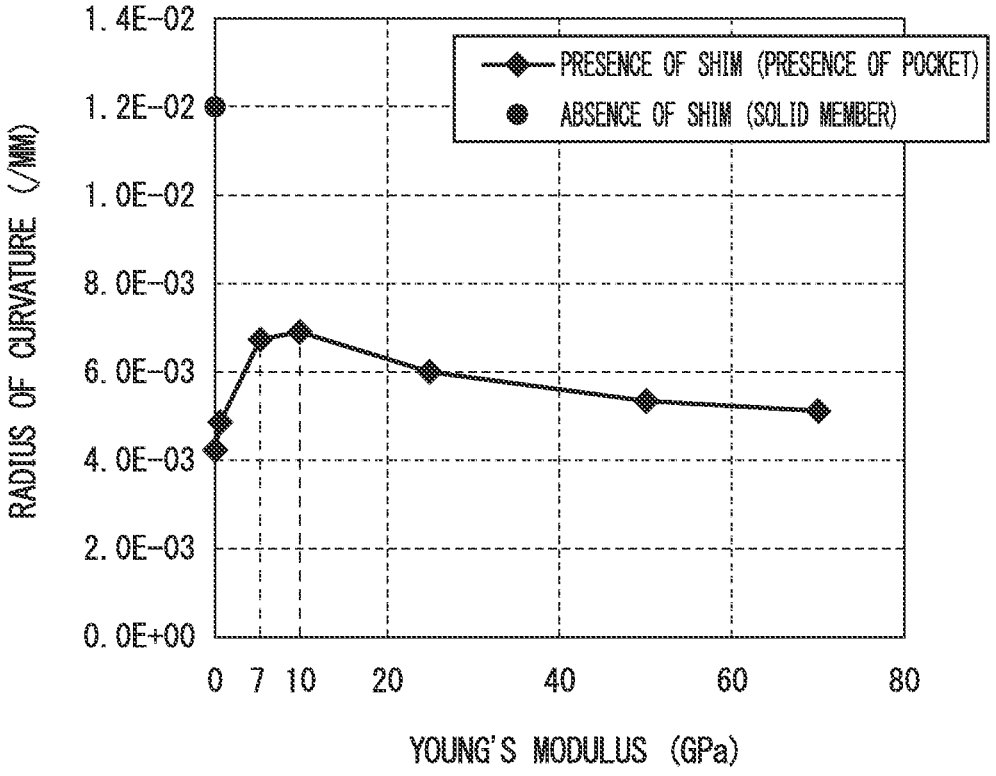
FIG. 11 is a graph showing a relationship between Young's moduli of a shim and a radius of curvature.

As shown in FIG. 11, according to the analysis results, it will be appreciated that the radius of curvature is increased at the Young's modulus of the shim of 7 to 10 GPa. In addition, for the purpose of comparison, the case in which wall thinning is not performed (a solid member) is also shown.

While the embodiments of the molding method for a plate-shaped workpiece and the molded article in accordance with the present invention have been described, the present invention is not limited to the above-mentioned embodiments but may be appropriately modified without departing from the spirit of the present invention.

For example, while the first, second and third embodiments have employed the press machine 2 in the bending process, the bending processing is not limited thereto but may employ a roll bending machine. In addition, the stretch molding machine 102 used in the bending process of the fourth embodiment is not limited to the structure described in the embodiment.

In the second, third and fifth embodiments, while Bakelite has been employed as the shim 3, the material is not limited thereto but may be other materials such as epoxy resin, unsaturated polyester, or the like, or a member in which these materials are filled with glass fiber may be used.

The shim 3 may be temporarily fixed to prevent separation from the pocket 11. In brief, the shim 3 loosely fitted into the pocket 11 may be slipped within a tolerance range thereof to be in a state in which elastic deformation can be made by the bending.

While the third embodiment has the stepped portion 11*a* having one stage formed in the pocket 11, the number of stages can be arbitrarily set, and two or more stages may be formed at the stepped portion 11*a*. For example, when the plate thickness dimension of the plate-shaped workpiece 1 is large, a multi-stage stepped portion can be provided, and when the plate thickness dimension is small, one stage or no step portion can be provided.

In addition, components in the above-mentioned embodiments may be appropriately replaced with well-known components, and further, the above-mentioned embodiments may be appropriately assembled with each other, without departing from the spirit of the present invention.

INDUSTRIAL APPLICABILITY

The present invention relates to a molding method for a plate-shaped workpiece and a molded article manufactured according to the same. According to the present invention, manufacturing efficiency of the curved plate-shaped workpiece can be improved, and generation of industrial waste can be suppressed.

DESCRIPTION OF REFERENCE NUMERALS

1 . . . plate-shaped workpiece (molded article)
1*a* . . . concave surface (first surface)
2 . . . press machine
3 . . . shim
3*a* . . . stepped portion
4 . . . protective member
11 . . . pocket (concave portion)
11*a* . . . stepped portion
21 . . . lower mold
22 . . . upper mold
102 . . . stretch molding machine
121 . . . lower mold

The invention claimed is:

1. A molding method for a plate-shaped workpiece comprising a first surface and a second surface, the first surface formed of a flat surface, and a second surface positioned opposite to the first surface on the plate-shaped workpiece and formed of a flat surface, the molding method comprising:

forming a concave portion at the first surface of the plate-shaped workpiece, wherein the plate-shaped workpiece is one piece;

forming a first stepped portion at a corner of the first surface side of the concave portion, wherein the first stepped portion has a stepped shape;

inserting a shim formed with a second stepped portion and formed of a material having a lower Young's modulus than that of the plate-shaped workpiece into the concave portion so that at least a portion of the first stepped portion is engaged with the second stepped portion; and pressing the plate-shaped workpiece against a mold member to perform bending processing, wherein a shape of the first surface becomes a concave surface shape.

2. The molding method for a plate-shaped workpiece according to claim 1, wherein the plate-shaped workpiece is bent by press or roll bending such that the second surface becomes a convex surface shape.

3. The molding method for a plate-shaped workpiece according to claim 1, wherein the concave portion comprises a plurality of concave portions formed at the first surface of the plate-shaped workpiece at predetermined intervals.

4. The molding method for a plate-shaped workpiece according to claim 1, wherein the concave portion comprises a plurality of concave portions, and the shim comprises a plurality of shims having a shape corresponding to the plurality of concave portions, respectively.

5. The molding method for a plate-shaped workpiece according to claim 4, wherein the plurality of shims are formed so as to be slightly smaller than an inner hole dimension of the plurality of concave portions, respectively.

6. The molding method for a plate-shaped workpiece according to claim 4, wherein the plurality of shims are formed of phenol resin having a Young's modulus of 7 to 10 GPa.

7. The molding method for a plate-shaped workpiece according to claim 1, wherein, as a tensile force is applied to the plate-shaped workpiece while the mold member abuts the first surface of the plate-shaped workpiece, the plate-shaped workpiece is bent such that the second surface becomes a convex surface shape.

8. The molding method for a plate-shaped workpiece according to claim 7, wherein the concave portion comprises a plurality of concave portions formed at the first surface of the plate-shaped workpiece at predetermined intervals.

9. The molding method for a plate-shaped workpiece according to claim 7, wherein the concave portion comprises a plurality of concave portions, and the shim comprises a plurality of shims having a shape corresponding to the plurality of concave portions, respectively.

10. The molding method for a plate-shaped workpiece according to claim 7, wherein the plate-shaped workpiece having the concave portion is formed such that a first ratio of a maximum cross-sectional area of the workpiece in a tensile direction divided by a minimum cross-sectional area of the workpiece in the tensile direction is less than or equal to a second ratio of tensile strength divided by proof stress of a material which forms the workpiece.

11. A molded article manufactured by the molding method for a plate-shaped workpiece according to claim 1.

12. The molding method for a plate-shaped workpiece according to claim 2, wherein the concave portion comprises a plurality of concave portions formed at the first surface of the plate-shaped workpiece at predetermined intervals.

13. The molding method for a plate-shaped workpiece according to claim 2, wherein the concave portion comprises a plurality of concave portions, and the shim comprises a plurality of shims having a shape corresponding to the plurality of concave portions, respectively.

14. The molding method for a plate-shaped workpiece according to claim 3, wherein the concave portion comprises a plurality of concave portions, and the shim comprises a plurality of shims having a shape corresponding to the plurality of concave portions, respectively.

15. The molding method for a plate-shaped workpiece according to claim 12, wherein the shim comprises a plurality of shims having a shape corresponding to the plurality of concave portions, respectively.

16. The molding method for a plate-shaped workpiece according to claim 13, wherein the plurality of shims are formed so as to be slightly smaller than an inner hole dimension of the plurality of concave portions, respectively.

17. The molding method for a plate-shaped workpiece according to claim 14, wherein the plurality of shims are formed so as to be slightly smaller than an inner hole dimension of the plurality of concave portions, respectively.

18. The molding method for a plate-shaped workpiece according to claim 15, wherein the plurality of shims are formed at a minus tolerance slightly smaller than an inner hole dimension of the plurality of concave portions, respectively.

19. The molding method for a plate-shaped workpiece according to claim 5, wherein the plurality of shims are formed of phenol resin having a Young's modulus of 7 to 10 GPa.

* * * * *